US012509131B2

(12) United States Patent
Pittman et al.

(10) Patent No.: US 12,509,131 B2
(45) Date of Patent: Dec. 30, 2025

(54) TRAIN SIMULATOR TEST SET AND METHOD THEREFOR

(71) Applicant: BNSF Railway Company, Fort Worth, TX (US)

(72) Inventors: Daniel E. Pittman, Kansas City, MO (US); Ross M. Sterling, Gardner, KS (US)

(73) Assignee: BNSF Railway Company, Fort Worth, TX (US)

( * ) Notice: Subject to any disclaimer, the term of this patent is extended or adjusted under 35 U.S.C. 154(b) by 352 days.

(21) Appl. No.: 17/816,533

(22) Filed: Aug. 1, 2022

(65) Prior Publication Data

US 2022/0363297 A1 Nov. 17, 2022

Related U.S. Application Data

(63) Continuation of application No. 17/470,556, filed on Sep. 9, 2021, now Pat. No. 11,427,235.

(60) Provisional application No. 63/075,991, filed on Sep. 9, 2020.

(51) Int. Cl.
*B61L 25/02* (2006.01)
*B61L 25/06* (2006.01)

(52) U.S. Cl.
CPC ..... *B61L 25/021* (2013.01); *B61L 25/023* (2013.01); *B61L 25/06* (2013.01)

(58) Field of Classification Search
None
See application file for complete search history.

(56) References Cited

U.S. PATENT DOCUMENTS

| | | | | |
|---|---|---|---|---|
| 3,838,271 | A | 9/1974 | Ackard et al. | |
| 4,307,860 | A * | 12/1981 | Kuhn | B61L 29/286 246/128 |
| 7,363,187 | B2 | 4/2008 | Winkler et al. | |
| 9,671,487 | B2 | 6/2017 | Harp et al. | |
| 9,751,545 | B2 * | 9/2017 | Steffen, II | B61L 27/60 |
| 9,862,395 | B2 | 1/2018 | Nagrodsky et al. | |
| 2003/0010872 | A1 * | 1/2003 | Lewin | B61L 25/025 246/122 R |

(Continued)

FOREIGN PATENT DOCUMENTS

| | | | |
|---|---|---|---|
| CN | 103023588 | B | 4/2015 |
| EP | 3312072 | A1 | 4/2018 |

(Continued)

*Primary Examiner* — Adam D Tissot
(74) *Attorney, Agent, or Firm* — Whitaker Chalk Swindle & Schwartz PLLC; Enrique Sanchez, Jr.

(57) ABSTRACT

A train simulator test set is disclosed that can be operably coupled to a railroad track to measure the resting impedance of that track circuit and simulate a train by varying the railroad track inductance over a set period of time. The test set can select the speed, direction, and number of trains to simulate. By applying a variable inductance on the railroad tracks, the test set can simulate a train moving at variable speeds toward and away from the island. The test set can apply inductances to the railroad tracks to simulate two or more trains moving in each direction of the tracks at the same time, along with multiple looks and routes. The train simulator test set can include simulation software to vary the parameters of the train simulation and couple a variable inductance on the railroad tracks.

20 Claims, 8 Drawing Sheets

(56) References Cited

U.S. PATENT DOCUMENTS

| | | | | |
|---|---|---|---|---|
| 2010/0219256 | A1 | 9/2010 | Williams | |
| 2016/0090113 | A1* | 3/2016 | Nagrodsky | B61L 1/18 246/34 R |
| 2017/0030993 | A1* | 2/2017 | Harp | G01R 35/005 |
| 2017/0197646 | A1* | 7/2017 | Shubs, Jr. | B61L 27/40 |
| 2020/0015667 | A1 | 1/2020 | Adachi | |
| 2020/0070861 | A1 | 3/2020 | Yano et al. | |
| 2020/0156678 | A1* | 5/2020 | Moss | H04B 10/25891 |
| 2021/0146972 | A1* | 5/2021 | Ross | B61L 15/0036 |
| 2021/0146980 | A1* | 5/2021 | Corbo | B61L 1/16 |

FOREIGN PATENT DOCUMENTS

| | | | |
|---|---|---|---|
| GB | 1052802 | A | 12/1966 |
| JP | 2005153740 | A | 6/2005 |
| WO | 2019013815 | A1 | 1/2019 |

* cited by examiner

TRAIN SIMULATOR TEST SET AND METHOD THEREFOR

CROSS-REFERENCE TO RELATED APPLICATIONS

The present application is a Continuation Application of U.S. patent application Ser. No. 17/470,556, filed Sep. 9, 2021, which claims the benefit of U.S. Provisional Application No. 63/075,991, filed Sep. 9, 2020, the contents of which are incorporated herein in their entireties for all purposes.

CROSS-REFERENCE TO RELATED APPLICATIONS

The present application claims the benefit of U.S. Provisional Application No. 63/075,991, filed Sep. 9, 2020, the entirety of which is herein incorporated by reference for all purposes.

TECHNICAL FIELD

The present disclosure generally relates to railroad asset testing and more particularly to the testing of railroad track crossing components.

BACKGROUND

Railroads are massive infrastructure environments with a network of millions of assets that need to function and move in a structured, orderly, and safe manner. As a train travels along a railroad track, it will typically encounter a railroad crossing—a location where vehicles and other media can traverse the railroad tracks. The location where the crossing is established can be called an "island." As a train approaches, a train detection subsystem must signal would-be crossers that a train is approaching and that it is not safe to cross the railroad tracks at the island. The signaling can include flashers, a gate arm, a sound system, and actuators, among others. When placed in service, these systems must be tested to ensure proper operation. Accordingly, the train detection subsystem and the warning device control subsystem must be tested before a train approaches in order to promote the safe crossing of the railroad tracks.

To detect the presence of a train on a railway track an AC voltage can be applied to the rails, which can be shorted by a train. The two rails are configured to have different electrical potentials. When the potentials are connected by the wheels and axle of a train, the wheels and axel operate as a shunt, having an inductance, that can look like a short circuit of the electrical circuit. Basic train detection subsystems can look for a short circuit condition to identify whether a train is on the tracks, but more sophisticated train detection subsystems can measure the shunt inductance of the train to determine a location and speed of the train. Train detection subsystems can establish a section of the railroad track as a crossing approach. The crossing approach can be the length of track where a train detection subsystem can detect a train. The train detection subsystem can send a signal down the rails and detect changes in the signal values. As a train travels on those rails in the crossing approach, the inductance of the rails changes. The inductance of the rails can be measured by the train detection subsystem. These inductance measurements can be analyzed to determine a rate of change or a change in phase of the inductance. So, as a train travels along a railroad track, the inductance rate of change can be determined to determine the train speed and ultimately the time of arrival at the crossing island. Once the time of arrival is determined, the time at which to trigger the waring device control subsystem can be determined and initiated by the control system. Depending on the complexity of the crossing and the angles of the train's approach, among other variables, the time of arrival at the island can vary greatly. However, most crossings are "constant warning" crossings, which means they are designed to render a static train approach time of a minimum of 20 seconds.

Currently, there are only two options to test a crossing—shunting the track with hand-shunts or coordinating with a train crew to operate a train under a test coordinator's direction. Shunting the tracks by hand is the most common method but does not provide a true crossing test as the movement is not linear, meaning that if an individual places a shunt at the end of the approach, then moves to the 75% mark, then moves to the 50% mark, etc., the crossing predictor sees the train as "jumping" throughout the approach. Hand-shunting is meant to simulate train movement but does so poorly. Coordinating with a train is preferred but most often, not a viable option due to logistical hurdles, including train time monopolization, safety personnel or apparatus to block traffic through the island, among others. Additionally, train coordination is particularly difficult at complex locations with multiple routes into and out of the island and varying train speeds through the crossing. Watching actual trains through each approach is required for in-servicing new crossings but presents additional logistical hurdles that take time.

SUMMARY

The present disclosure achieves technical advantages as a train simulator test set that can be operably coupled to a railroad track to measure the resting impedance of that track circuit and simulate a train by varying the railroad track inductance over a set period of time. In one embodiment, the standard track connection accessible in a wayside house can be utilized. In another embodiment, the train simulator test set can be a portable case with a processor and test leads. The train simulator test set can include simulation software to vary the parameters of the train simulation and couple a variable inductance on the railroad tracks. In another embodiment, the train simulator test set can reside on an external device and can communicate with additional test sets to generate simulated train movement at multiple test set locations.

The test set can select the speed, direction, and number of trains to simulate. By applying a variable inductance on the railroad tracks, the test set can simulate a train moving at variable speeds toward and away from the island. The test set can apply inductances to the railroad tracks to simulate two or more trains moving in each direction of the tracks at the same time, along with multiple looks and routes. In one embodiment, the test set can programmatically determine and transmit the appropriate inputs to each crossing test set in a network to simulate the desired train speed including acceleration, deceleration, and a stopped train, among others. The test set can initiate the train simulation at the 100% crossing approach location and move train inward to the 0% crossing approach location while maintaining the inductance characteristics of a train along the track.

In one embodiment, data and instructions can be received from a remote master test set, when using more than one test set. In another embodiment, the test set can simulate train movement from 100% to 0% or 0% to 100% crossing approach location points. In another embodiment, multiple test sets can be utilized for crossings with DAX houses to test more complex locations. Test sets can communicate with each other via data radio, encrypted, unlicensed frequency (allow for daisy-chaining).

The present disclosure solves the technological problem of static testing of train detection subsystems at discrete points via manual or automated input. Additionally, the present disclosure solves the problem of coordinating with a train to conduct manual testing of railroad crossings.

The present disclosure improves the performance of the system itself by accurately simulating train movement along railroad tracks by varying the inductance applied to railroad tracks to trigger a warning device control system to operate warning device mechanisms so that proper operation can be verified. The test set can improve testing quality, efficiency, and confidence. The test set can also reduce the time spent testing crossings as capturing train moves will be negated.

In one embodiment, a train simulator test set configured simulate a train on a railroad track to test the functionality of crossing safety devices can include: a user interface configured to set one or more parameters of a simulated train; a plurality of cables configured to releasably couple to railroad track rails; a memory storing a plurality of train characteristics related to a vehicle and at least a portion of a track; and a processor operably coupled to the memory and capable of executing machine-readable instructions to perform program steps, the program steps including: receiving one or more train parameters; determining inductance values to simulate a train having the train parameters; generating an inductance using the calculated inductance values; and applying the generated inductance to the section of railroad track. Wherein the inductance values can be retrieved from the memory. Wherein the train parameters are received from the user interface. Wherein the train parameters are received from a remote device. The program steps further comprising measuring the resting impedance of a section of railroad track. The program steps further comprising receiving a track length. The program steps further comprising verifying the proper operation of one or more safety mechanisms. Wherein the inductance values are retrieved from a remote database. Wherein the memory includes a table of inductance values for different train parameters. Wherein the table of inductance values includes measured inductance values for a particular section of track. Wherein the inductance of the track can be measured and correlated with the track measurements for historical train crossing inductance values for the section of railroad track stored in memory.

In another embodiment, a method of simulating a train on a railroad track to test the functionality of crossing safety devices, the method can include the steps of: measuring the resting impedance of a section of railroad track; receiving one or more train parameters; determining inductance values to simulate a train having the train parameters; generating an inductance using the calculated inductance values; and applying the generated inductance to the section of railroad track. Further comprising verifying the proper operation of one or more safety mechanisms. Further comprising receiving a track length. Wherein the inductance values are retrieved from a memory. Wherein the train parameters are received from the user interface. Wherein the train parameters are received from a remote device. Wherein the inductance values are retrieved from a remote database. Wherein the memory includes a table of inductance values for different train parameters. Wherein the inductance of the track can be measured and correlated with the track measurements for historical train crossing inductance values for the section of railroad track stored in memory.

BRIEF DESCRIPTION OF THE DRAWINGS

The present disclosure will be readily understood by the following detailed description, taken in conjunction with the accompanying drawings that illustrate, by way of example, the principles of the present disclosure. The drawings illustrate the design and utility of one or more exemplary embodiments of the present disclosure, in which like elements are referred to by like reference numbers or symbols. The objects and elements in the drawings are not necessarily drawn to scale, proportion, or precise positional relationship. Instead, emphasis is focused on illustrating the principles of the present disclosure.

DETAILED DESCRIPTION

The disclosure presented in the following written description and the various features and advantageous details thereof, are explained more fully with reference to the non-limiting examples included in the accompanying drawings and as detailed in the description, which follows. Descriptions of well-known components have been omitted so to not unnecessarily obscure the principal features described herein. The examples used in the following description are intended to facilitate an understanding of the ways in which the disclosure can be implemented and practiced. Accordingly, these examples should not be construed as limiting the scope of the claims.

Figure 1:
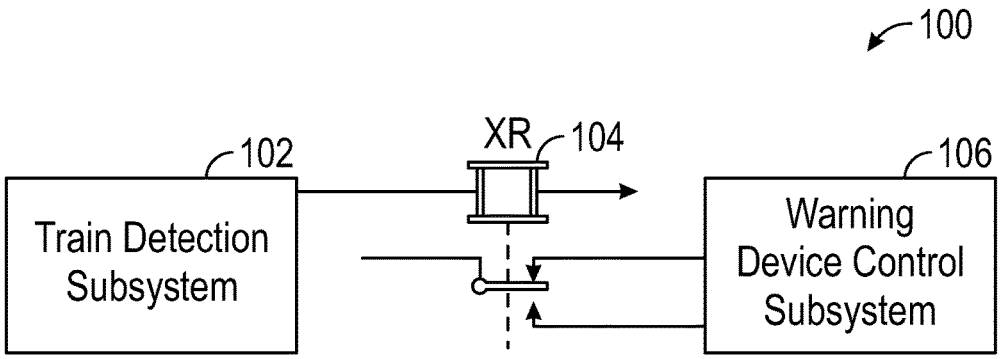
FIG. 1 illustrates a schematic view of a control system for active railroad crossings, in accordance with one or more exemplary embodiments of the present disclosure.

FIG. 1 illustrates a schematic view of a control system 100 for active railroad crossings, in accordance with one or more exemplary embodiments of the present disclosure. The control system 100 can include a train detection subsystem 102, a crossing control relay (XR) 104, and a warning device control subsystem 106. In one embodiment, when the train detection subsystem 102 detects a train, it can trigger the operation of the warning device control subsystem 106 via the crossing control relay (XR) 104. In another embodiment, the warning device control subsystem 106 can operate flashers, a gate arm, a sound system, and actuators, among others.

The aforementioned system components, and their sub-components, can be communicably coupled to each other via the Internet, intranet, mesh network, or other suitable network. The communication can be encrypted, unencrypted, over a VPN tunnel, or other suitable communication means. The Internet can be a WAN, LAN, PAN, or other suitable network. The network communication between the system components, and their sub-components, can be encrypted using PGP, Blowfish, Twofish, AES, 3DES, HTTPS, or other suitable encryption. The network communication can occur via application programming interface (API), ANSI-X12, Ethernet, Wi-Fi, Bluetooth, PCI, PCI-Express, Fiber, or other suitable communication protocol or medium. Additionally, third party databases can be operably connected to the system components.

The server can be implemented in hardware, software, or a suitable combination of hardware and software therefor, and may comprise one or more software systems operating on one or more servers, having one or more processors, with access to memory. Server(s) can include electronic storage, one or more processors, and/or other components. Server(s) can include communication lines, or ports to enable the exchange of information with a network and/or other computing platforms. Server(s) can also include a plurality of hardware, software, and/or firmware components operating together to provide the functionality attributed herein to server(s). For example, server(s) can be implemented by a cloud of computing platforms operating together as server(s). Additionally, the server can include memory.

Memory can comprise electronic storage that can include non-transitory storage media that electronically stores information. The electronic storage media of electronic storage may include one or both of system storage that can be provided integrally (i.e., substantially non-removable) with server(s) and/or removable storage that can be removably connectable to server(s) via, for example, a port (e.g., a USB port, a firewire port, etc.) or a drive (e.g., a disk drive, etc.). Electronic storage may include one or more of optically readable storage media (e.g., optical disks, etc.), magnetically readable storage media (e.g., magnetic tape, magnetic hard drive, floppy drive, etc.), electrical charge-based storage media (e.g., EEPROM, RAM, etc.), solid-state storage media (e.g., flash drive, etc.), and/or other electronically readable storage media. Electronic storage may include one or more virtual storage resources (e.g., cloud storage, a virtual private network, and/or other virtual storage resources). Electronic storage may store machine-readable instructions, software algorithms, information determined by processor(s), information received from server(s), information received from computing platform(s), and/or other information that enables server(s) to function as described herein. The electronic storage can also be accessible via a network connection.

Processor(s) may be configured to provide information processing capabilities in server(s). As such, processor(s) may include one or more of a digital processor, an analog processor, a digital circuit designed to process information, an analog circuit designed to process information, a state machine, control logic, and/or other mechanisms for electronically processing information, such as FPGAs or ASICs. The processor(s) may be a single entity or include a plurality of processing units. These processing units may be physically located within the same device, or processor(s) may represent processing functionality of a plurality of devices operating in coordination or software functionality.

The processor(s) can be configured to execute machine-readable instruction or learning modules by software, hardware, firmware, some combination of software, hardware, and/or firmware, and/or other mechanisms for configuring processing capabilities on processor(s). As used herein, the term "machine-readable instruction" may refer to any component or set of components that perform the functionality attributed to the machine-readable instruction component. This can include one or more physical processors during execution of processor readable instructions, the processor readable instructions, circuitry, hardware, storage media, or any other components.

The server can be configured with machine-readable instructions having one or more functional modules. The machine-readable instructions can be implemented on one or more servers, having one or more processors, with access to memory. The machine-readable instructions can be a single networked node, or a machine cluster, which can include a distributed architecture of a plurality of networked nodes. The machine-readable instructions can include control logic for implementing various functionality, as described in more detail below. The machine-readable instructions can include certain functionality associated with the system components, and their sub-components.

Figure 2A:
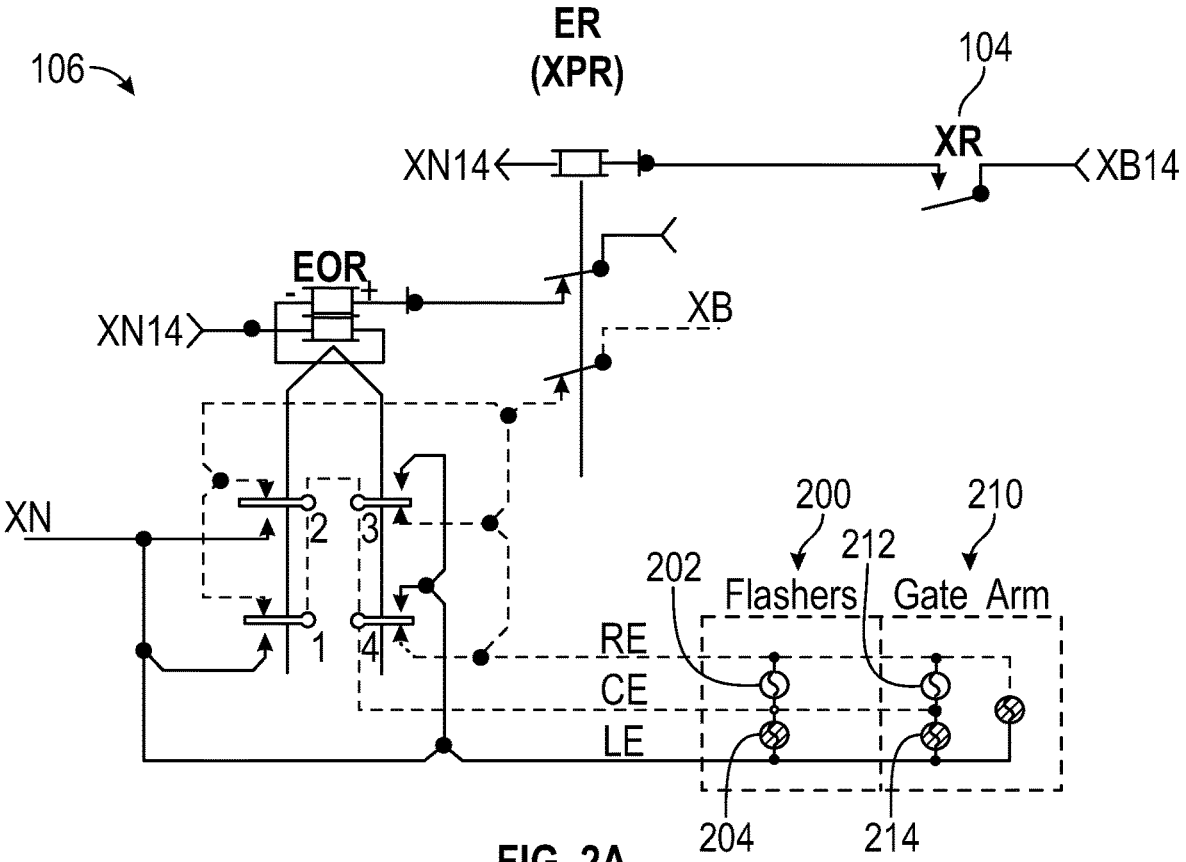
FIG. 2A illustrates a schematic view of a circuit for lighting the left lamps of a flasher unit, in accordance with one or more exemplary embodiments of the present disclosure.
Figure 2B:
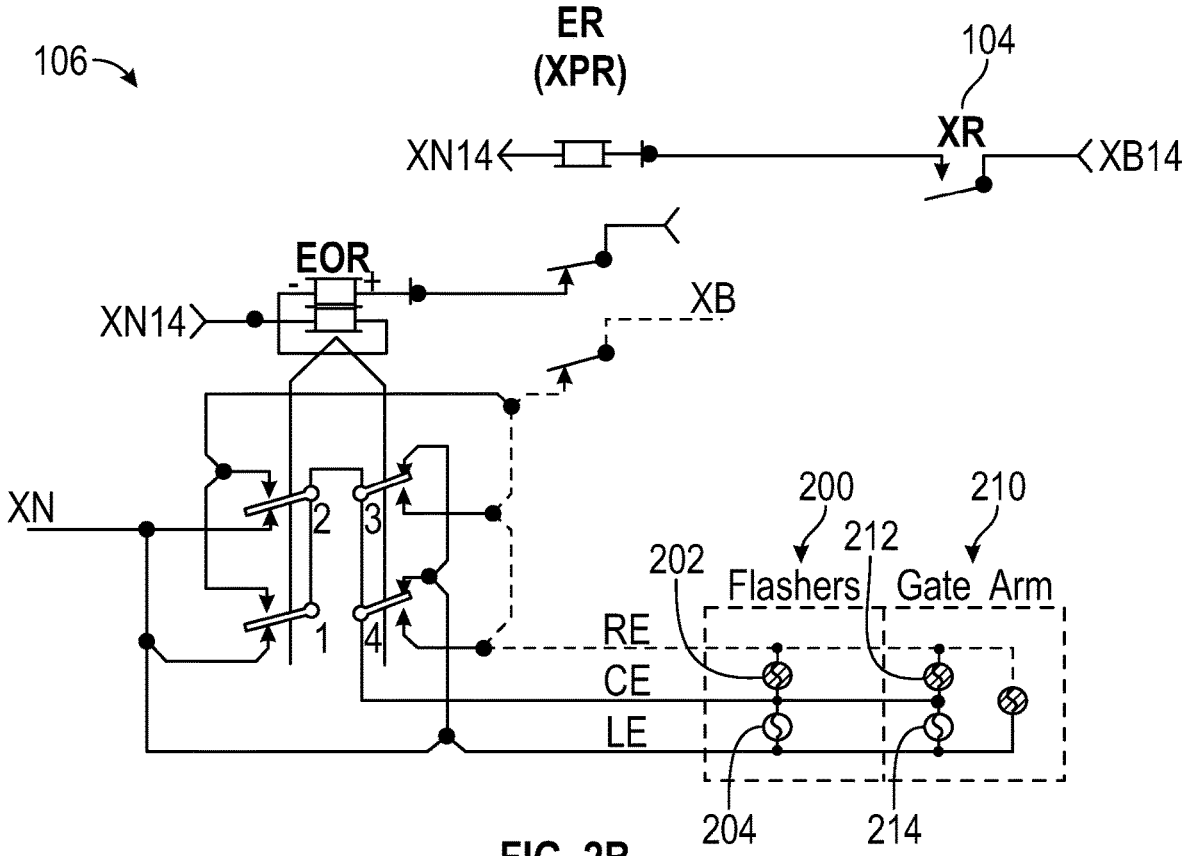
FIG. 2B illustrates a schematic view of a circuit for lighting the right lamps of a flasher unit, in accordance with one or more exemplary embodiments of the present disclosure.

FIG. 2A illustrates a schematic view of a circuit for lighting the left lamps 204 of a flasher unit 200, in accordance with one or more exemplary embodiments of the present disclosure. FIG. 2B illustrates a schematic view of a circuit for lighting the right lamps 202 of the flasher unit 200, in accordance with one or more exemplary embodiments of the present disclosure.

The crossing control relay (XR) 104 can pass a signal to the warning device control system 106 to trigger operation. The warning device control system 106 can control a flasher unit 200 to blink the left and right lamps 204, 202. In one embodiment, shown in FIG. 2A, when contacts 1 and 2 are closed and contacts 3 and 4 are open, the left lamps 204 of the flasher unit 200 are lit as the right lamps 202 are shunted through contacts 3 and 4 of the EOR. Additionally, the left gate arm 214 of the gate arm unit 210 is operated to drop the left gate arm 214 into a lowered position. The right gate arm 212 of the gate arm unit 210 is maintained in the raised position. In another embodiment, shown in FIG. 2B, when contacts 1 and 2 are open and contacts 3 and 4 are closed, the right lamps 202 of the flasher unit 200 are lit as the left lamps 204 are shunted through contacts 1 and 2 of the EOR. Additionally, the right gate arm 212 of the gate arm unit 210 is operated to drop the right gate arm 212 into a lowered position. The left gate arm 214 of the gate arm unit 210 is maintained in the raised position.

Figure 3A:
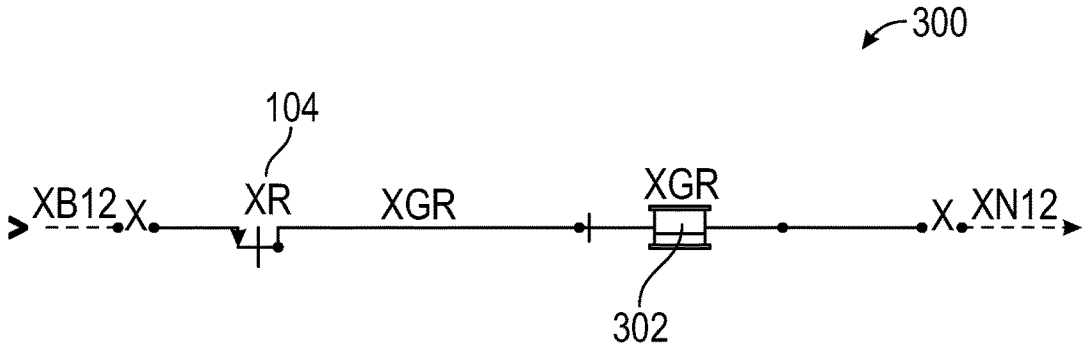
FIG. 3A illustrates a schematic view of a circuit for sending a signal to trigger gate operation, in accordance with one or more exemplary embodiments of the present disclosure.
Figure 3B:
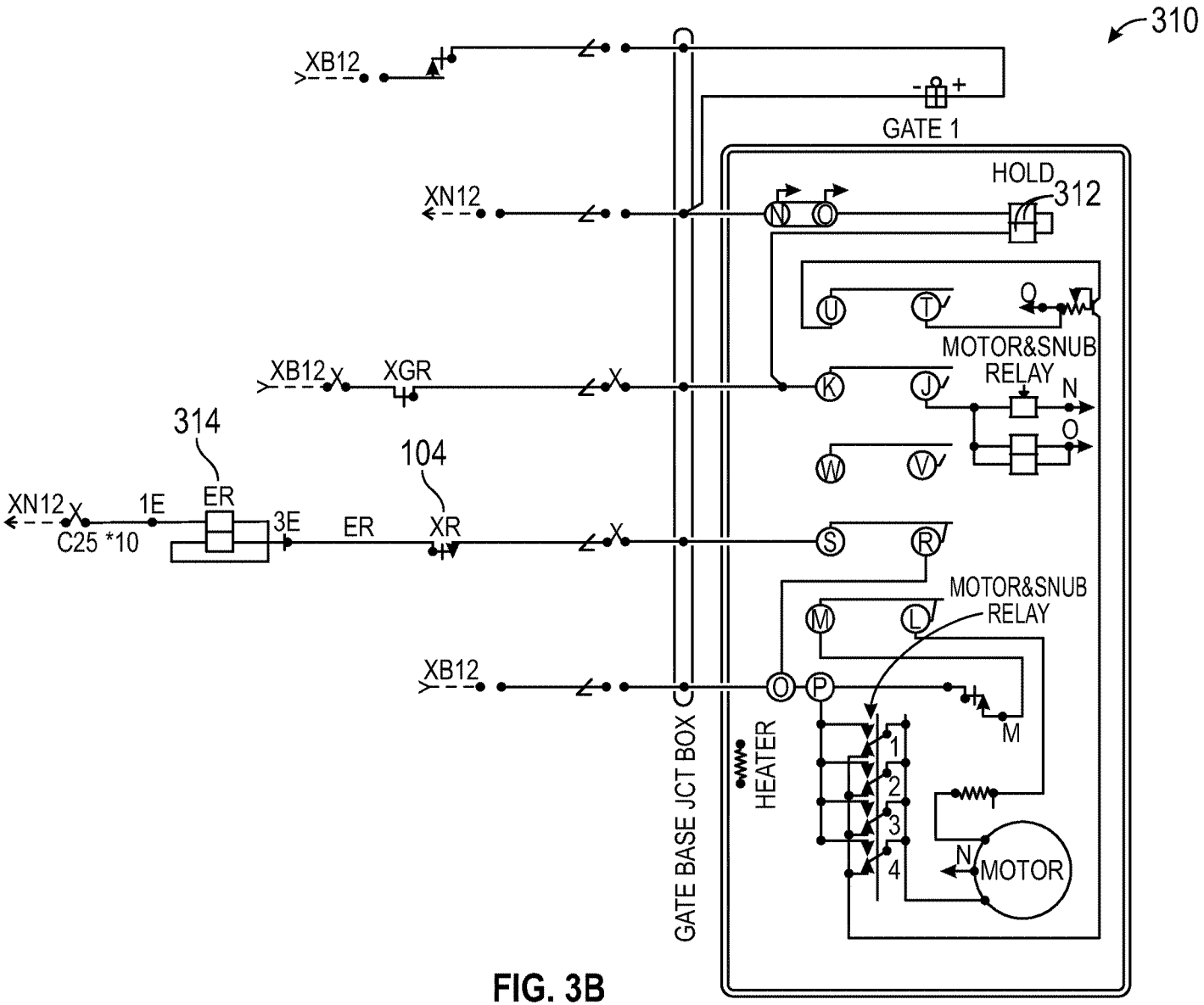
FIG. 3B illustrates a schematic view of a circuit for operating a gate, in accordance with one or more exemplary embodiments of the present disclosure.

FIG. 3A illustrates a schematic view of a circuit 300 for sending a signal to trigger gate operation, in accordance with one or more exemplary embodiments of the present disclosure. FIG. 3B illustrates a schematic view of a circuit 310 for operating a gate, in accordance with one or more exemplary embodiments of the present disclosure. The gate arm unit 210 of FIG. 2B can contain one or more gate circuits 310 to control one or more gates. As shown in FIG. 3A, the crossing control relay (XR) 104 allows the XB12 signal to propagate as XN12 to the gate circuit 300 through the crossing gate relay (XGR) 302. As shown in FIG. 3B, the XR 104 opens the ER circuit 314 to start the flashing lights. After a first period of time (e.g., 3 seconds), the XGR 302 removes energy from the "hold clear" device 312 to release the gate and drops the ER relay 314. The ER circuit 314 is de-energized whenever the XR 104 is down, or the gate is NOT vertical.

Figure 4:
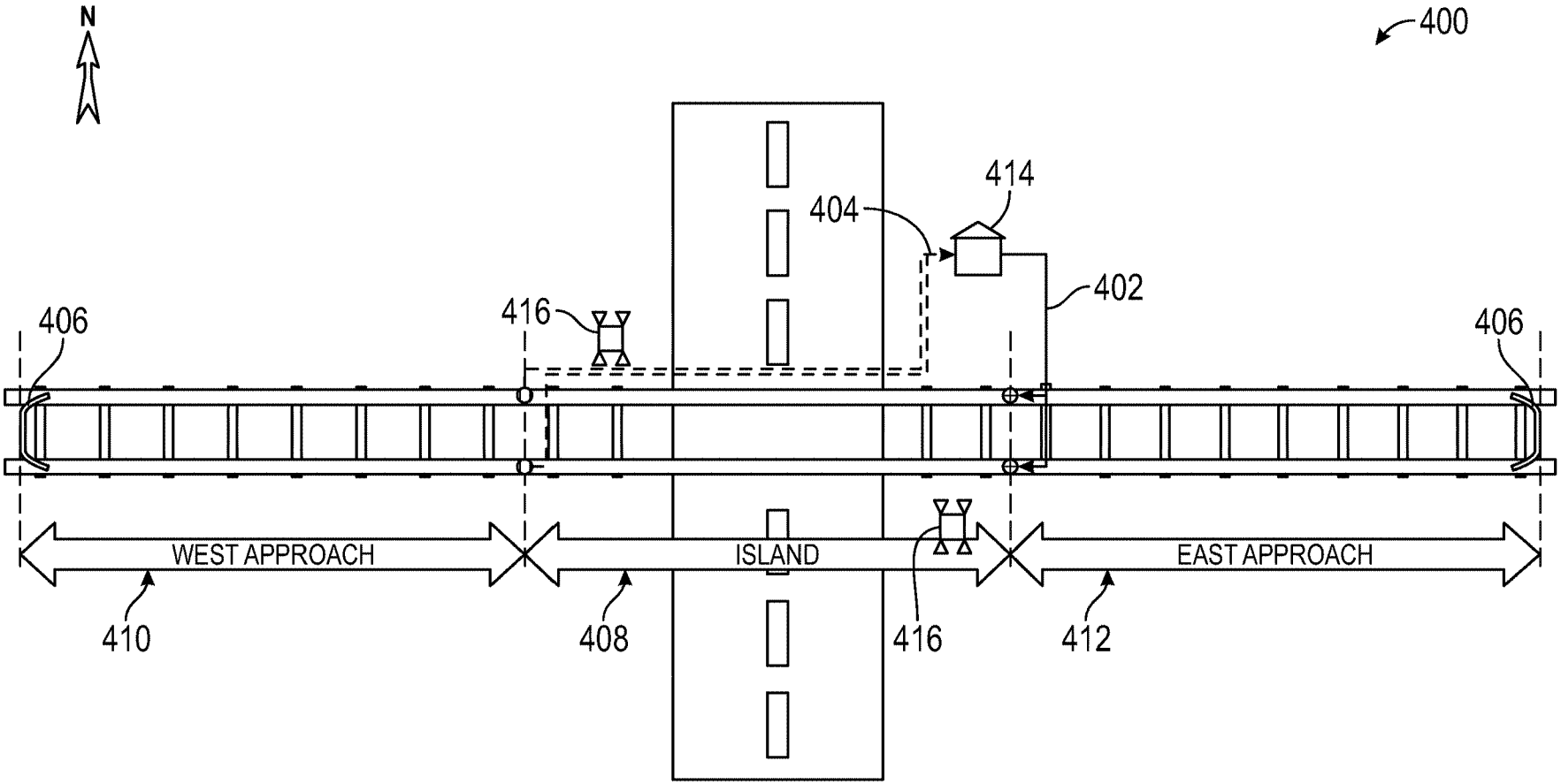
FIG. 4 illustrates a schematic view of a railroad crossing at rest (with no train), in accordance with one or more exemplary embodiments of the present disclosure.

FIG. 4 illustrates a schematic view of a railroad crossing at rest (with no train), in accordance with one or more exemplary embodiments of the present disclosure. In one embodiment, prior to a train's arrival, crossing predictors disposed in the test set's memory or control logic can store the resting state of the unoccupied tracks. This resting state may be known as the "full approach" or "100 RX." Crossing predictors can require extensive testing and calibrations. A section of track 400 can include a west approach section 410, an island section 408, and an east approach section 412. In another embodiment, the termination shunt 406 can be disposed on the west-most end of the west approach section 410 and a second termination shunt 406 can be disposed on the east-most end of the east approach section 412, thereby defining the section of railroad track. A warning system 416 can include one or more gates, flashers, speakers, or other suitable warning components. At rest, the warning system 416 has its gate up and its flashers off.

In one embodiment, transmit island wires 402 can be operably coupled to the rails of the railroad tracks. For example, a first end of first transmit island wire can be operably coupled to a first rail of a section of railroad track and a first end of a second transmit island wire can be operably coupled to a second rail of a section of railroad track. A second end of the transmit island wires 402 can be disposed within a wayside house 414. In another embodiment, the transmit island wires 402 can be operably coupled to the railroad track rails at the point where the island section 408 meets the east approach section 412.

In one embodiment, receive island wires 404 can be operably coupled to the rails of the railroad tracks. For example, a first end of first receive island wire can be operably coupled to a first rail of a section of railroad track and a first end of a second receive island wire can be operably coupled to a second rail of a section of railroad track. A second end of the receive island wires 404 can be disposed within a wayside house 414. In another embodiment, the receive island wires 404 can be operably coupled to the railroad track rails at the point where the island section 408 meets the west approach section 410.

As discussed above, a train simulator test set can be operably coupled to a railroad track to measure the resting impedance of that track circuit and simulate a train by varying the railroad track inductance over a set period of time. The test set can select the speed, direction, and number of trains to simulate. By applying a variable inductance on the railroad tracks, the test set can simulate a train moving at variable speeds toward and away from the island. The test set can apply inductances to the railroad tracks to simulate two or more trains moving in each direction of the tracks at the same time, along with multiple looks and routes. The train simulator test set can include simulation software to vary the parameters of the train simulation and couple a variable inductance on the railroad tracks.

However, when complex crossings (with multiple routes into and out of the island and varying train speeds through the crossing), the test set can be coupled at each one of our track locations to measure the resting impedance of those track circuits. In one embodiment, the test set can transmit these resting impedances back to a master test set unit or central program. In another embodiment, each test set could be independently triggered to vary impendences to simulate train movement. For example, given a test set on one side of an island (crossing) and a test set 2 on the other side of the island, test set 1 can be configured to vary from 100% to 0% over 12 seconds; as soon as test set 1 gets to 0, test set 2 can be triggered to vary from 100% to 0% in a second time frame, based on test set 2's resting impedance, based on the track length of test set 2. Accordingly, train movement can be simulated through the island. In operation, the test set can shunt the train track to mimic the impedance of the tracks as a train travels down the track. The test set can be coupled to the track so that the resting impedance of the track can be determined and matched. Then the phase of the inductance can be varied to change the inductance across the tracks so the system determines that a train is navigating through that track system. By measuring the phase change of the inductance across the tracks, the train detection subsystem 102 can determine the speed and location of the simulated train and operate the warning device control subsystem 106.

In one embodiment, a test set can include a processor having control logic. In another embodiment, the test set can be disposed within a portable case (e.g., a Pelican case). For example, the test set can be housed within a water-tight enclosure that is IP-69 rated to withstand harsh elements when being used outdoors. For example, the casing can be constructed of a polypropylene copolymer material for maximum strength while remaining light-weight. In another embodiment, the test set can be IP-67 rated with the lid in the open position while the test set is being actively utilized. In another embodiment, the test set can include cables and/or adapters that can be operably coupled to railroad tracks or the wires that lead to the railroad tracks. In another embodiment, one cable can be coupled to each rail. In another embodiment, the test set can be powered by internally housed rechargeable batteries. For example, the rechargeable batteries can be charged by any 9-36 VDC power source, or a 120 VAC outlet to 12 VDC USB-C style adapter.

In another embodiment, the test set can communicate wirelessly. For example, the test set can have a 900 MHz radio that can communicate with other test sets that may be used at various locations such as DAX crossing houses, within range. In another embodiment, a portable, detachable, collapsible, magnetically mounted antenna can be included with the test that can be affixed to any ferrous metal surface and connected to the train simulator test set via mini-UHF cable and connector. In another embodiment, the test set can include a screen. For example, the test set can include a touch screen or a 4×20 character LED screen with various soft press buttons, such that a user can navigate through different screens to see and adjust settings and functions. In another embodiment, the settings, functions, and visual indications can include system status, internal battery charge level (e.g., percentage or icon), charge indication, internal memory space remaining, radio strength, radio strength of other test sets within range, unique pair ID to confirm linking of other test sets, test set configuration parameters, crossing RX, crossing phase, crossing transmit voltage, and file name of each log playback of each simulated train. For example, the log can include a file name, size, date, and last 4 of test set serial-number. In another embodiment, data (e.g., logs, parameters, etc.) can be exported from the test set via an external drive (e.g., USB flash drive).

In one embodiment, the test set can replicate the inductance of a train as it moves across the track and then these signals can then be received by the train detection subsystem, crossing predictor, the motion detector, or other suitable device. In one embodiment, the train detection subsystem can receive the inductance signals generated by the test set, process that data, and generate an electromechanical combination. In another embodiment, the electronic logic and variables for the system can be stored within the train detection subsystem, as well as the mechanical state of the relays, gates, and the flashers.

In one embodiment, a plurality of test sets can be coupled to a section of track so that a particular section of track can be covered for train detection. If another train approaches from a turn out, the test set would have to be positioned at the next one over and all other test sets shifted downstream. So if a train is in the direction the crossing predictor is monitoring, for example to the east, and another crossing predictor is looking to the west, in another embodiment, the test set should be changed so that it corresponds with that train movement (depending on the monitoring direction).

Figure 5:
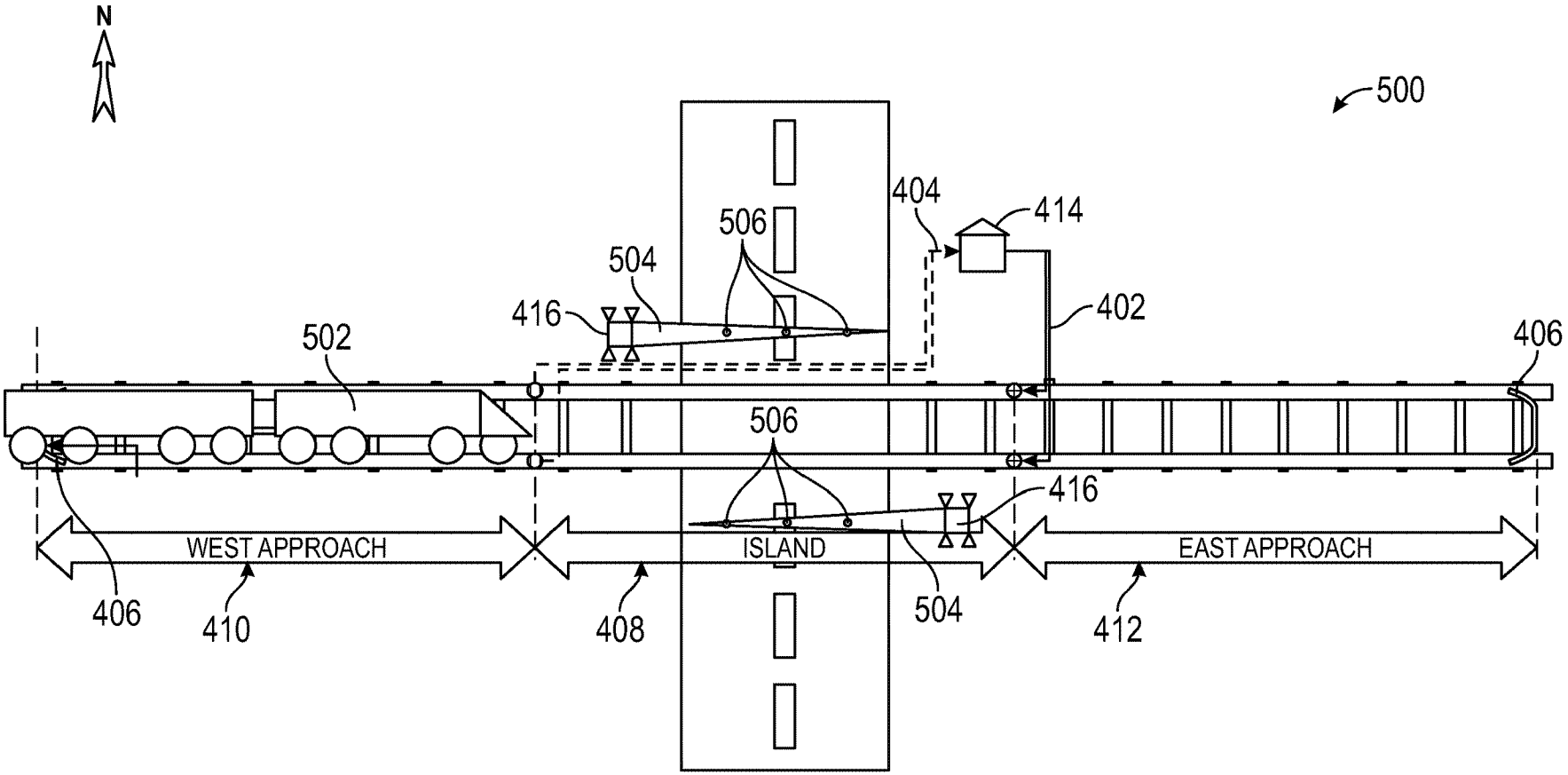
FIG. 5 illustrates a schematic view of a railroad crossing at work (with train), in accordance with one or more exemplary embodiments of the present disclosure.

FIG. 5 illustrates a schematic view of a railroad crossing at work (with train) 500, in accordance with one or more exemplary embodiments of the present disclosure. In one embodiment, as the axels of a train 502 move past the termination shunt, the amplitude of the crossing frequency changes. The crossing predictor can detect this change in frequency and amplitude and calculate how long it will take the train 502 to reach the "occupied approach" (0 RX—the time the axles move into the island). When a train 502 is detected, the warning system 416 lowers its gate 504 and activates its flashers 506. In another embodiment, the gates 504 can drop when the predictor calculates when the train will reach the island 408 at a time of no less than the minimum designated warning time.

Figure 6:
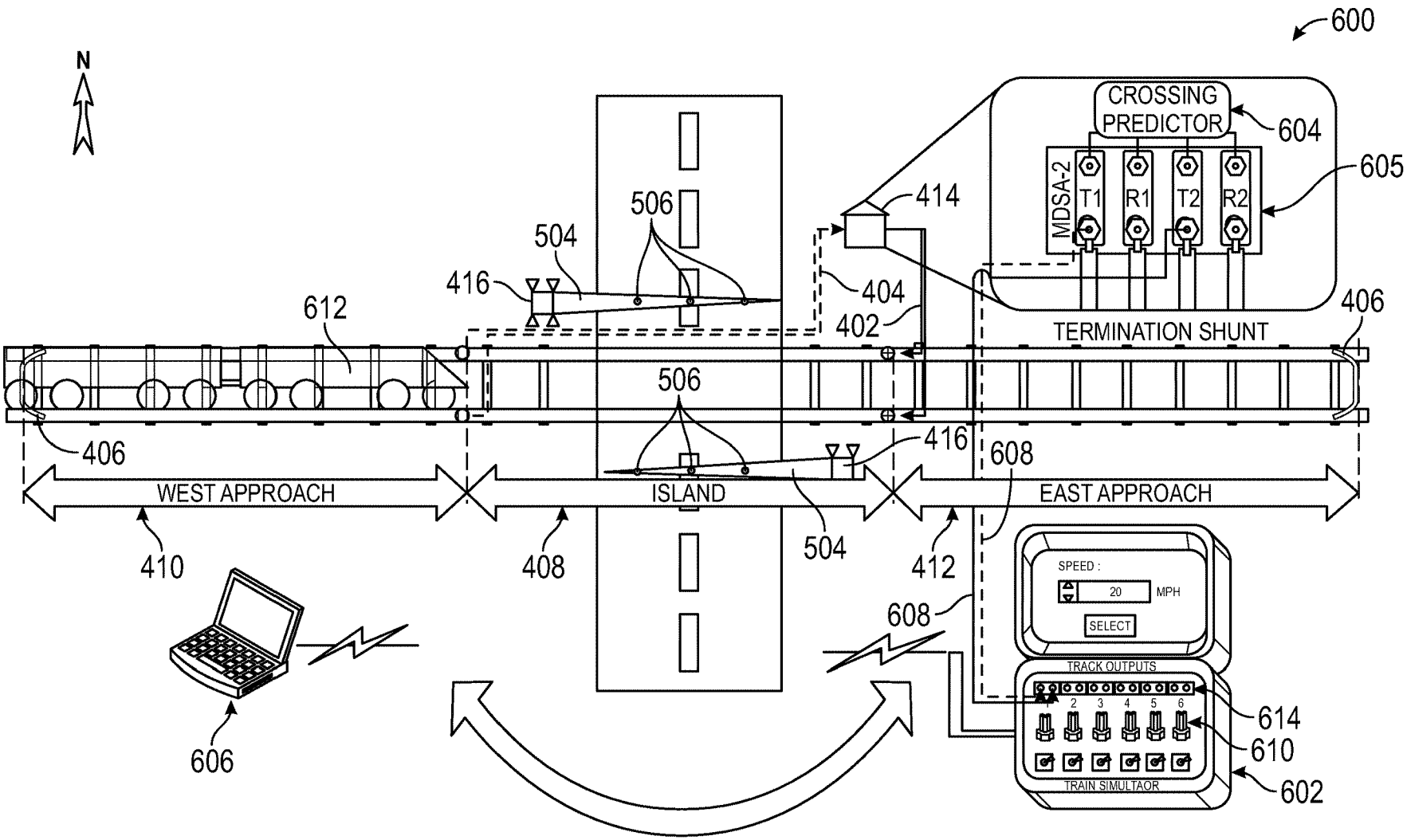
FIG. 6 illustrates a schematic view of a railroad crossing at rest (with test set and train), in accordance with one or more exemplary embodiments of the present disclosure.

FIG. 6 illustrates a schematic view of a railroad crossing at rest (with test set and simulated train) 600, in accordance with one or more exemplary embodiments of the present disclosure. In one embodiment, a test set 602 can simulate a train 612 by incorporating the data parameters of the train at the full approach (100 RX) and the occupied approach (0 RX). The test set 602 can then mimic the movement of a train by taking the 100 RX and transitioning it to 0 RX at a certain rate of time, in a linear fashion, by varying the inductance between the inductance received by the crossing predictor when the train is at 100 RX and the inductance received by the crossing predictor when the train is at 0 RX. In this manner, the warning time of the crossing predictor 604 can be tested.

In one embodiment, the route, speed, direction, and number of trains can be programmed using the test set 602. In another embodiment, the test set 602 can include a user interface 610 configured to set one or more parameters of a simulated train 612. For example, the user interface 610 can provide for the selection of one or more parameters via, e.g., one or more knobs, dials, switches, graphical interfaces, touch screens, or other suitable user input. In another embodiment, the route, speed, direction, and number of trains can be programmed remotely. For example, the test set 602 can communicate with a remote device 606. In another embodiment, the test set 602 can communicate with other remote devices 602 over a wired or wireless network. In one embodiment the crossing predictor 604 can include or be operably coupled to a Motion Detector Surge Arrester 605. The test set 602 can be operably coupled to the crossing predictor 604 via the MDSA 605 via one or more cables 608. In another embodiment, the test set can include one or more track outputs 614. For example, the track outputs 614 can receive a lead (cable). In another embodiment, the test set 602 can transmit a signal to the crossing predictor via the cable operably coupled to the track output 614.

Figure 7:
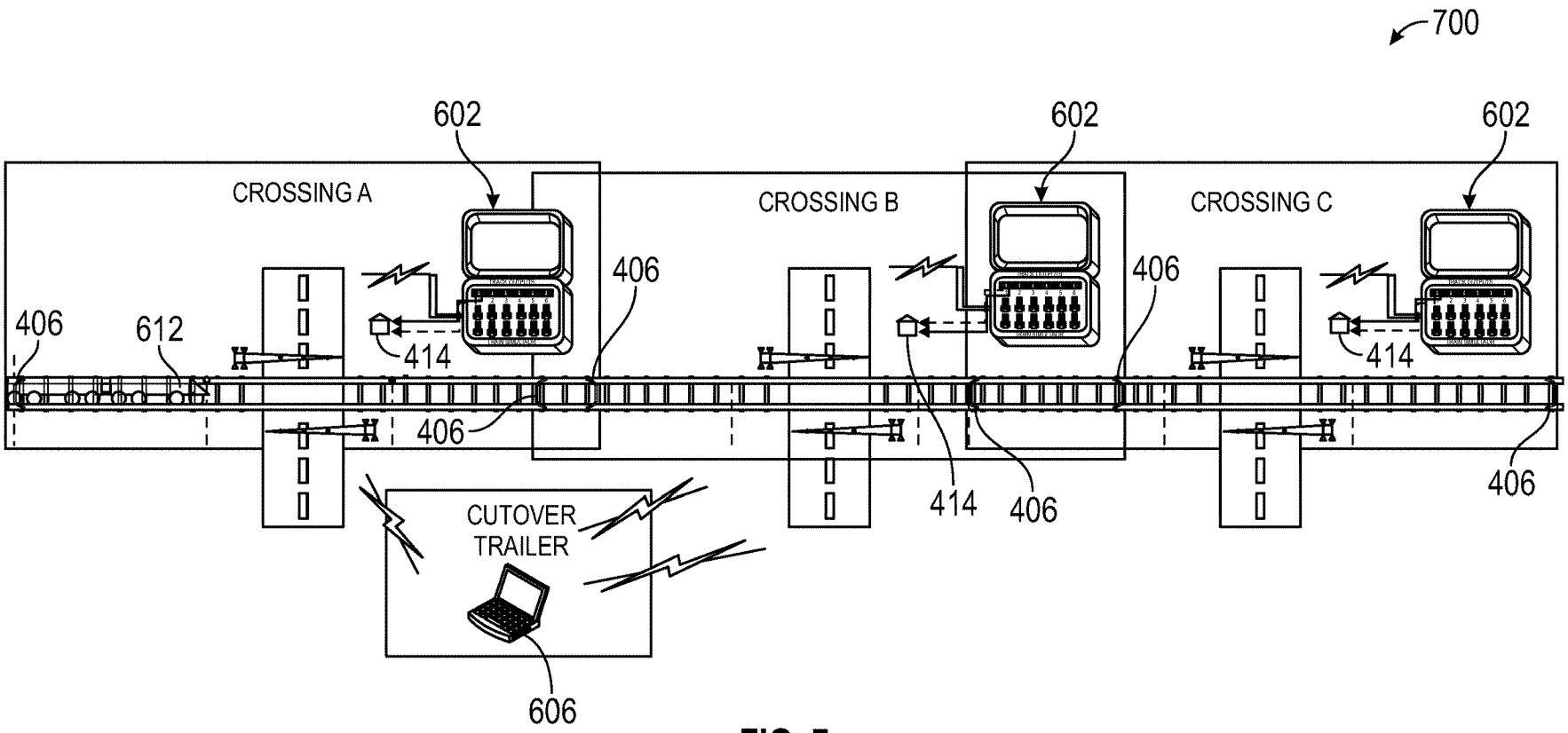
FIG. 7 illustrates a schematic view of a railroad track configuration with multiple crossing test sets, in accordance with one or more exemplary embodiments of the present disclosure.

FIG. 7 illustrates a schematic view of a railroad track configuration with multiple crossing test sets 700, in accordance with one or more exemplary embodiments of the present disclosure. In one embodiment, a remote device 606 can be remotely positioned to connect to multiple test sets. For example, the remote device 606 can be a controller, processor, server, computer, control logic, or other suitable device. In another embodiment the remote device 606 can coordinate a single train simulated move through a plurality of crossings. In another embodiment, the test sets 602 can be coordinated in sequential order. In another embodiment, the test set 602 can be used to run routes for wayside locations. In another embodiment, the test set 602 can be used for automated testing. In another embodiment, after a simulated train 502 reaches the island 408, the test set 602 can simulate another train 502 leaving the island to allow the train detection subsystem to monitor other conditions (e.g., tailring conditions).

Figure 8:
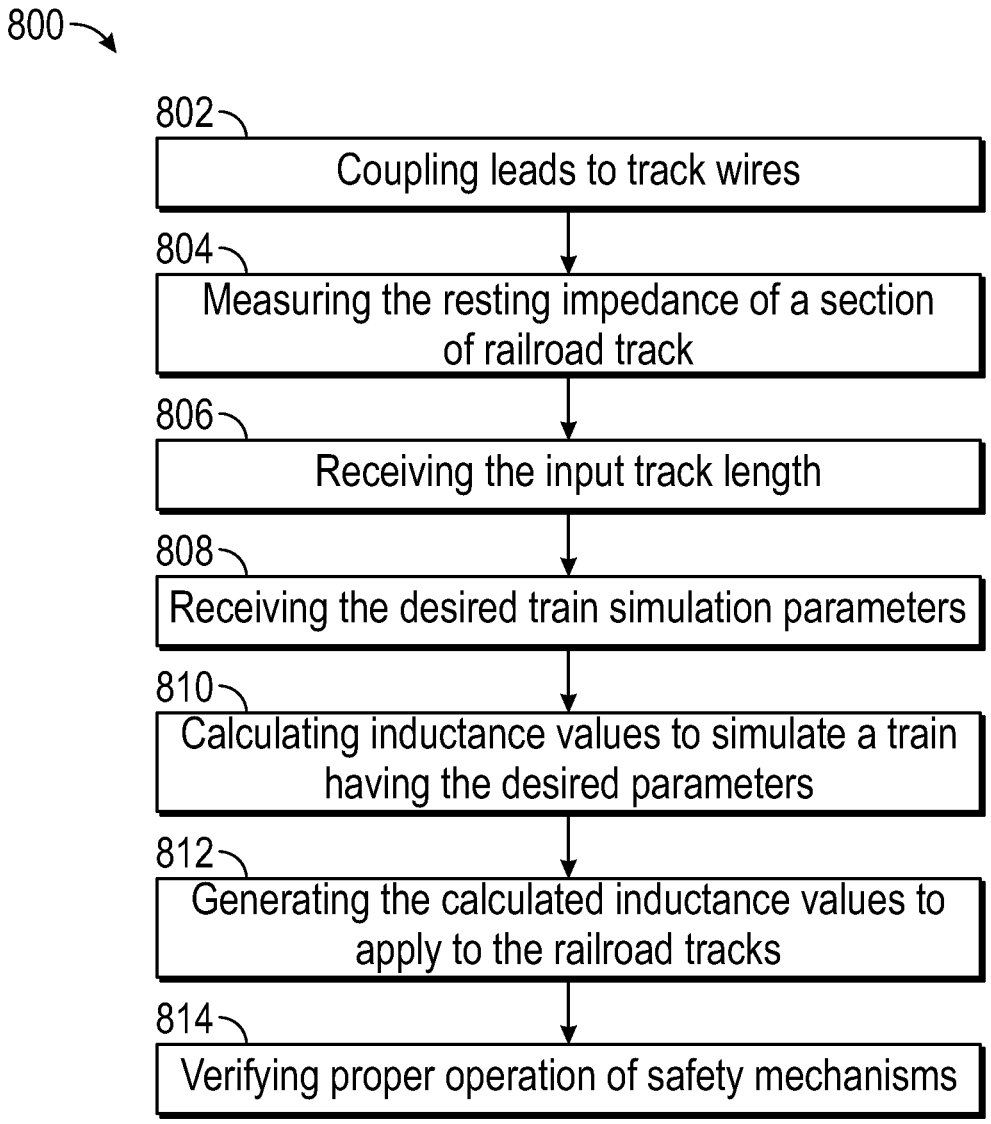
FIG. 8 illustrates a flow chart for an exemplary process for simulating a train on a railroad track, in accordance with one or more exemplary embodiments of the present disclosure.

FIG. 8 illustrates a flow chart diagram exemplifying control logic 800 embodying features of a method of simulating a train on a railroad track, in accordance with one or more exemplary embodiments of the present disclosure. The train simulation control logic 800 can be implemented as an algorithm on a processor, a server, a machine learning module, controller, or other suitable system. The control logic 800 can be achieved via software, hardware, an application programming interface (API), a network connection, a network transfer protocol, HTML, DHTML, JavaScript, Dojo, Ruby, Rails, other suitable applications, or a suitable combination thereof.

The control logic 800 can leverage the ability of a computer platform to spawn multiple processes and threads by processing data simultaneously. The speed and efficiency of the control logic 800 can be greatly improved by instantiating more than one process to simulate a train on a railroad track. However, one skilled in the art of programming will appreciate that use of a single processing thread may also be utilized and is within the scope of the present invention. In one embodiment, the control logic 800 can instantiate various modules of the server.

At 802, the test set can include leads that can be operably coupled to railroad tracks or railroad track wires. For example, the test set leads can include a rail adapter such as alligator clips, banana clips, biding post, panel mount, vice grips, magnet, or other suitable attachment adapter to releasably couple the leads to the railroad track rails. In one embodiment, a standard track connection in a wayside house can be utilized to connect the test set to the railroad tracks. In another embodiment, the train simulator test set can be a portable case with a processor and test leads. In another embodiment, the control logic can be coupled directly to the railroad tracks.

The control logic 800 process flow of the present embodiment begins at step 804, where the control logic 800 can measure the resting impedance of a section of railroad track. In one embodiment, the control logic 800 can transmit a signal along the railroad track rails and detect changes in the signal values. For example, as a train travels along the rails in a crossing approach, the inductance of the rails can change. The inductance of the rails can be measured by control logic 800. The control logic 800 can analyze these inductance measurements to determine a rate of change or a change in phase of the inductance. For example, as a train travels along a railroad track, the inductance rate of change can be determined to determine the train speed and ultimately the time of arrival at a crossing island. Once the time of arrival is determined, the time at which to trigger the waring device control subsystem can be determined and initiated by the control system. The control logic 800 then proceeds to step 806.

At step 806, the control logic 800 can receive a track length. The control logic 800 can establish a section of the railroad track as a crossing approach. For example, the crossing approach can be the length of track where a train detection subsystem can detect a train. The control logic 800 then proceeds to step 808.

At step 808, the control logic 800 can receive the desired train simulation parameters. In one embodiment, the speed, direction, and number of trains to simulate can be received. For example, the test set can include a user interface allowing the selection of one or more parameters via one or more dials, switches, graphical interfaces, or other suitable user input. In another embodiment, the control logic 800 can simulate two or more trains. For example, simulated trains can follow each other sequentially on a section of track, or approach from different directions sequentially. The control logic 800 can start the simulation of the train at the 100% approach (furthest point) and move train inward to the 0% mark (closest point to the test set) while maintaining inductance properties of a train. In another embodiment, multiple test sets can be used for crossings with DAX houses to test more complex locations much quicker. The control logic 800 then proceeds to step 810.

At step 810, the control logic 800 can determine or calculate inductance values to simulate a train having the desired parameters. In one embodiment, the control logic 800 can retrieve stored inductance values related to measured train values. For example, the inductance values can be stored in the test set memory or a remote database. In another embodiment, the memory can contain a table of inductance values for different train parameters. In another embodiment, the table of inductance values can contain measured inductance values for a particular section of track. In another embodiment, the control logic can measure the inductance of the track and correlate the track measurements with historical train crossing values stored in memory. In another embodiment, the control logic 800 can correlate the received train parameters with the stored inductance table to determine the proper inductance values to simulate a train crossing. The control logic then proceeds to step 812.

At step 812, the control logic 800 can generate the calculated inductance values to apply to the railroad tracks. The control logic then proceeds to step 814.

At step 814, the control logic 800 can verify proper operation of safety mechanisms. In one embodiment, the test set can receive an indication from the warning device control subsystem 106 that the safety mechanisms were properly operated. The control logic can then terminate or await a new train simulation request and repeat the aforementioned steps.

The present disclosure achieves at least the following advantages:

1. improves the performance of the system by allowing for safer, more cost-effective testing of train crossing safety components;
2. provides granularity and variability of testing to account for different train-related conditions;
3. provides a portable platform for providing easy and efficacious safety system testing; and
4. provides metrics that can point to railroad savings or areas for quality improvement.

Persons skilled in the art will readily understand that these advantages (as well as the advantages indicated herein) and objectives of this system would not be possible without the particular combination of computer hardware and other structural components and mechanisms assembled in this inventive system and described herein. It will be further understood that a variety of programming tools, known to persons skilled in the art, are available for implementing the control of the features and operations described in the foregoing material. Moreover, the particular choice of programming tool(s) may be governed by the specific objectives and constraints placed on the implementation selected for realizing the concepts set forth herein and in the appended claims.

The description in this disclosure should not be read as implying that any particular element, step, or function can be an essential or critical element that must be included in the claim scope. Also, none of the claims can be intended to invoke 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," "processing device," or "controller" within a claim can be understood and intended to refer to structures known to those skilled in the relevant art, as further modified or enhanced by the features of the claims themselves, and can be not intended to invoke 35 U.S.C. § 112(f). Even under the broadest reasonable interpretation, in light of this paragraph of this specification, the claims are not intended to invoke 35 U.S.C. § 112(f) absent the specific language described above.

The disclosure may be embodied in other specific forms without departing from the spirit or essential characteristics thereof. For example, each of the new structures described herein, may be modified to suit particular local variations or requirements while retaining their basic configurations or structural relationships with each other or while performing the same or similar functions described herein. The present embodiments are therefore to be considered in all respects as illustrative and not restrictive. Accordingly, the scope of the inventions can be established by the appended claims rather than by the foregoing description. All changes which come within the meaning and range of equivalency of the claims are therefore intended to be embraced therein. Further, the individual elements of the claims are not well-understood, routine, or conventional. Instead, the claims are directed to the unconventional inventive concept described in the specification.

What is claimed is:

1. A train simulator test set configured simulate a train on a railroad track to test the functionality of crossing safety devices, comprising:

a user interface configured to set or display one or more parameters of a simulated train;

a plurality of cables configured to releasably couple to railroad track rails;

a memory storing a plurality of train and railroad track characteristics; and a processor operably coupled to the memory and capable of executing machine-readable instructions to perform program steps, the program steps including:

measuring a resting impedance of a section of railroad track;

receiving an input track length;

receiving a plurality of desired train simulation parameters;

calculating, based on the received desired train simulation parameters, inductance values that that correspond to the inductance characteristics of a train having the desired train simulation parameters;

generating the calculated inductance values and applying the inductance to the railroad tracks; and verifying, based on the application of the inductance to the railroad track, proper operation of the crossing safety devices.

2. The train simulator test set of claim 1, wherein the inductance values can be retrieved from the memory.

3. The train simulator test set of claim 1, wherein the desired train simulation parameters are received from the user interface.

4. The train simulator test set of claim 1, wherein the desired train simulation parameters are received from a remote device.

5. The train simulator test set of claim 1, the program steps further comprising measuring the inductance of a section of railroad track.

6. The train simulator test set of claim 1, wherein the input track length is a length of the measured section of railroad track.

7. The train simulator test set of claim 1, the program steps further comprising correlating the measured railroad track impedance with stored values for the section of railroad track to identify the one or more simulated train parameters.

8. The train simulator test set of claim 7, wherein the inductance values are retrieved from a remote database.

9. The train simulator test set of claim 1, wherein the memory includes a table of inductance values for different train parameters.

10. The train simulator test set of claim 9, wherein the table of inductance values includes measured inductance values for a particular section of track.

11. The train simulator test set of claim 10, wherein the inductance of the track can be measured and correlated with the track measurements of stored train crossing inductance values for the section of railroad track stored in memory.

12. A method of simulating a train on a railroad track to test the functionality of crossing safety devices, the method comprising the steps of:

measuring a resting impedance of a section of railroad track;

receiving an input track length;

receiving a plurality of desired train simulation parameters;

calculating, based on the received desired train simulation parameters, inductance values that correspond to the inductance characteristics of a train having the desired train simulation parameters;

generating the calculated inductance values and applying the inductance to the railroad tracks; and verifying, based on the application of the inductance to the railroad track proper operation of the crossing safety devices.

13. The method of claim 12, further comprising correlating the measured railroad track impedance with stored values for the section of railroad track to identify the one or more simulated train parameters.

14. The method of claim 12, wherein the input track length is a length of the measured section of railroad track.

15. The method of claim 12, wherein the inductance values are retrieved from a memory.

16. The method of claim 12, wherein the train simulation parameters are received from the user interface.

17. The method of claim 12, wherein the train simulation parameters are received from a remote device.

18. The method of claim 12, wherein the inductance values are retrieved from a remote database.

19. The method of claim 15, wherein the memory includes a table of inductance values for different train parameters.

20. The method of claim 15, wherein the inductance of the track can be measured and correlated with the track measurements of stored train crossing inductance values for the section of railroad track stored in memory.

* * * * *